US011141781B2

(12) United States Patent
Oh et al.

(10) Patent No.: US 11,141,781 B2
(45) Date of Patent: Oct. 12, 2021

(54) ROLLER ASSEMBLY, CASTING APPARATUS, AND ROLLER SEPARATING METHOD FOR SAME

(71) Applicant: POSCO, Pohang-si (KR)

(72) Inventors: Kyung Shik Oh, Pohang-si (KR); Young Hoon Kang, Gwangyang-si (KR); Joo Dong Lee, Pohang-si (KR); Ki Hwan Joung, Gwangyang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 16/637,495

(22) PCT Filed: Aug. 8, 2018

(86) PCT No.: PCT/KR2018/009039

§ 371 (c)(1),
(2) Date: Feb. 7, 2020

(87) PCT Pub. No.: WO2019/031849

PCT Pub. Date: Feb. 14, 2019

(65) Prior Publication Data

US 2020/0215605 A1 Jul. 9, 2020

(30) Foreign Application Priority Data

Aug. 9, 2017 (KR) ..... 10-2017-0101208

(51) Int. Cl.
*B22D 11/128* (2006.01)

(52) U.S. Cl.
CPC ..... *B22D 11/1287* (2013.01); *B22D 11/1282* (2013.01)

(58) Field of Classification Search
CPC ..... B22D 11/128; B22D 11/1282; B22D 11/1287; B22D 11/208
(Continued)

(56) References Cited

U.S. PATENT DOCUMENTS 3,891,025 A 6/1975 Bollig et al.

FOREIGN PATENT DOCUMENTS

CN 101291759 10/2008
CN 103691900 4/2014
(Continued)

OTHER PUBLICATIONS

English machine translation of JP 9-220654 A dated Aug. 26, 1997 (Year: 1997).*

(Continued)

*Primary Examiner* — Kevin P Kerns
(74) *Attorney, Agent, or Firm* — Cantor Colburn LLP

(57) ABSTRACT

Provided is a roller assembly which includes: a supporter configured to rotatably support a roller disposed in a movement path of a to-be-treated material; a fixed shaft attached to a rear surface of the supporter and having at least a stretchable portion; a body attached to the rear surface side of the supporter so as to surround the fixed shaft; and a plunger attached so as to connect the body and the fixed shaft and formed so that at least a portion thereof advances and retreats with respect to the movement path, a casting device provided with the roller assembly, and a roller separating method, wherein the roller assembly is capable of separating the roller from the movement path during emergency.

2 Claims, 4 Drawing Sheets

(58) Field of Classification Search
USPC ..... 164/484, 413, 441, 442, 447, 448
See application file for complete search history.

(56) References Cited

FOREIGN PATENT DOCUMENTS

| | | | | | |
|---|---|---|---|---|---|
| DE | 102008004915 | | | 7/2009 | |
| EP | 1754556 | | | 2/2007 | |
| JP | S53142522 | | | 4/1977 | |
| JP | 08108256 | | | 4/1996 | |
| JP | 9-220654 | A | * | 8/1997 | ..... B22D 11/128 |
| JP | 09220654 | | | 8/1997 | |
| KR | 20060022407 | | | 3/2006 | |
| KR | 100862779 | | | 10/2008 | |
| KR | 20130075611 | | | 7/2013 | |
| KR | 20140002097 | | | 1/2014 | |
| KR | 101632347 | | | 6/2016 | |
| KR | 20170065963 | | | 6/2017 | |
| KR | 20170073633 | | | 6/2017 | |
| TW | 495400 | | | 7/2002 | |

OTHER PUBLICATIONS

European Search Report—European Application No. 18843075.5 dated Apr. 17, 2020, citing JP H09-220654, U.S. Pat. No. 3,891,025, and EP 1754556.

PCT Written Opinion—PCT/KR2018/009039 dated Nov. 14, 2018, citing JP 09-220654.

International Search Report—PCT/KR2018/009039 dated Nov. 14, 2018.

Chinese Office Action—Chinese Application No. 201880051573.3 dated Dec. 25, 2020, citing JP H09220654, EP 1754556, U.S. Pat. No. 3,891,025, DE 102008004915, TW 495400, CN 101291759, and CN 103691900.

Japanese Office Action—Japanese Application No. 2020-505774 dated Mar. 2, 2021, citing JP 09-220654 and JP 53-142522.

* cited by examiner

ROLLER ASSEMBLY, CASTING APPARATUS, AND ROLLER SEPARATING METHOD FOR SAME

CROSS-REFERENCE TO RELATED APPLICATIONS

This application is a national entry of PCT Application No. PCT/KR2018/009039 filed on Aug. 8, 2018, which claims priority to and the benefit of Korean Application No. 10-2017-0101208 filed Aug. 9, 2017, in the Korean Patent Office, the entire contents of which are incorporated herein by reference.

TECHNICAL FIELD

The present disclosure relates to a roller assembly, a casting apparatus, and a roller separating method for the same, and more particularly, to a roller assembly in which rollers are retreatable from the movement path of a to-be-treated material, a casting apparatus in which a roller fused to a slab on the movement path is separable during emergency, and a roller separating method for the casting apparatus.

BACKGROUND ART

Continuous casting equipment is the equipment for producing slabs using molten steel, and is configured by a turndish for storing a molten steel, a mold for receiving the molten steel in the turndish and firstly solidifying the molten steel into a slab form; and segments for drawing the slab from the mold and secondly cooling the slab. At this point, the segments are consecutively arranged under the mold along the movement path of the slab.

Segments of related arts each include: a plurality of guide rolls which are consecutively arranged under the mold and rolls the slab while guiding the slab; a plurality of roller assemblies which rotatably support both end sections of the guide rolls; an upper frame and a lower frame which are continuously arranged under the mold, are spaced apart from each other so as to face each other with the movement path of the slab therebetween; a plurality of tie rods for connecting the upper and lower frames spaced part from each other and facing each other; and a hydraulic cylinder which is capable of adjusting the gap between the upper and lower frames spaced part from each other and facing each other.

The segments having the hydraulic cylinder according to related arts are frequently damaged due to high-temperature and high-humidity operation environments and high ferrostatic pressure inside the slab. At this point, the mainly damaged portion is the hydraulic cylinder portion, and recently, a structure in which the hydraulic cylinder is removed and roll gaps are fixed has been mainly used.

Meanwhile, when an emergent situation occurs such as outflow of the molten steel or retention of slabs, a series of operations are sequentially performed in which the slab inside a segment is cut, and the segment is removed together with the slab, and then completely repaired and replaced with a new segment in waiting, from the upstream to the downstream of the movement path.

At this point, when the thickness of the slab is large, it is impossible to cut the slab, and the segment should be separately removed, but in the above-described emergent situation, most rollers are fused to the slab, and therefore it is difficult to separate the segment to recover the equipment and deal with the emergent situation.

Background technology of the present disclosure is disclosed in the following patent document.

RELATED ART DOCUMENTS

Patent Documents (Patent document 1) KR10-2017-0065963 A

DISCLOSURE OF THE INVENTION

Technical Problem

The present disclosure provides a roller assembly capable of causing a roller to retreat from the movement path of a to-be-treated material The present disclosure also provides a casting device capable of separating a roller fused to a slab in a movement path during emergency.

The present disclosure also provides a roller separating method capable of separating a roller fused to a slab in a movement path during emergency.

Technical Solution

In accordance with an exemplary embodiment, a roller assembly which is capable of causing a roller to retreat from a movement path of a to-be-treated material includes: a supporter configured to rotatably support the roller disposed in the movement path; a fixed shaft attached to a rear surface of the supporter and having at least a stretchable portion; a body attached to the rear surface side of the supporter so as to surround the fixed shaft; and a plunger attached so as to connect the body and the fixed shaft and formed so that at least a portion thereof advances and retreats with respect to the movement path.

The plunger may be formed such that at least a portion thereof, while retreating by means of a hydraulic pressure, causes the fixed shaft to retreat from the movement path.

The plunger may be attached to pass through a rear surface of the body and be connected to a rear end of the fixed shaft.

The plunger may include: a hollow outer cylinder having a front end attached to the rear surface of the body, and an inner stepped portion formed on an inner circumferential surface thereof, the inner diameter of a rear end thereof from the inner stepped portion being larger than the inner diameter of a front end thereof; an inner cylinder attached to pass through the outer cylinder and having an outer stepped portion on an outer circumferential surface thereof, the outer circumferential surface thereof being in contact with the inner circumferential surface of the outer cylinder, a connecting shaft formed to protrude from a front end of the inner cylinder, passing through the rear surface of the body, and connected to a rear end of the fixed shaft; and an injection port attached to pass through the outer cylinder so as to form a hydraulic pressure by injecting a fluid into a hydraulic pressure space formed by the inner stepped portion and the outer stepped portion.

The plunger may further include an injection port valve attached to the injection port and opened in an intermittent manner.

In accordance with another exemplary embodiment, a casting apparatus for casting a slab using a mold, includes a plurality of segments consecutively arranged under the mold so as to guide a movement of the slab drawn from the mold, and the segments comprises: a plurality of rollers consecutively arranged along a movement path and spaced apart from each other so as to face each other with the movement path of the slab therebetween; and a plurality of roller assemblies attached to the plurality of rollers and having at least a portion capable of advancing and retreating with respect to the movement path.

The segments may include a first frame and a second frame spaced apart from each other so as to face each other with the movement path therebetween, the first frame and the second frame support the plurality of roller assemblies, and the roller assemblies may be formed such that at least a portion thereof may cause the rollers to retreat from the movement path while retreating by means of hydraulic pressure.

The roller assemblies may each include: a supporter configured to rotatably support the roller; a fixed shaft attached to a rear surface of the supporter and having at least a stretchable portion; a body attached to the rear surface side of the supporter so as to surround the fixed shaft; and a plunger attached so as to pass through a rear surface of the body, connected to a rear end of the fixed shaft, and formed so that at least a portion thereof advances and retreats with respect to the movement path by means of hydraulic pressure.

In accordance with another exemplary embodiment, a roller separating method for separating a roller from a slab in a movement path, the method includes: drawing the slab from a mold; guiding a movement of the slab drawn from the mold using a plurality of segments consecutively arranged along the movement path; and causing a plurality of roller assemblies, which are attached to a plurality of rollers provided to the segments, and have at least a portion formed so as to advance and retreat with respect to the movement path of the slab, to retreat from the movement path and causing the rollers supported by the roller assemblies to be spaced apart from the slab when the slab is being moved or stops.

The causing the rollers to be spaced apart from the slab may include: applying a hydraulic pressure into the roller assemblies and causing a portion of the roller assemblies to retreat from the movement path; and causing the rollers connected to the portion of the roller assemblies to retreat from the movement path.

The causing the rollers to retreat from the slab to be spaced apart from the slab may further include applying the hydraulic pressure in an intermittent manner when applying the hydraulic pressure to the roller assemblies.

Advantageous Effects

In accordance with an exemplary embodiment, a plurality of rollers, consecutively arranged along the movement path of a to-be-treated material can easily be caused to retreat from the movement path of the to-be-treated material by using a plunger structure provided so as to easily cause only a portion of an apparatus to retreat.

For example, when applied to continuous casting equipment, roller assemblies of segments are configured as roller assemblies to which the plunger structures are applied, and when a roller is fused to a slab due to outflow of a molten steel, retention of slabs, or the like, hydraulic pressure is formed inside the corresponding roller assembly using the plunger structure, and a fixed shaft of each of the roller assembly can be caused to retreat from the movement path of a slab, and the roller supported by the fixed shaft can easily be separated from the slab.

That is, during an emergent situation such as outflow of molten steel or retention of slabs, a roller can forcibly be spaced apart from a slab by applying a hydraulic pressure to the plunger of a roller assembly, and thus, slabs and the continuous casting equipment can be easily and quickly separated, and the time and man power required to recover the equipment can remarkably be reduced.

MODE FOR CARRYING OUT THE INVENTION

Figure 1:
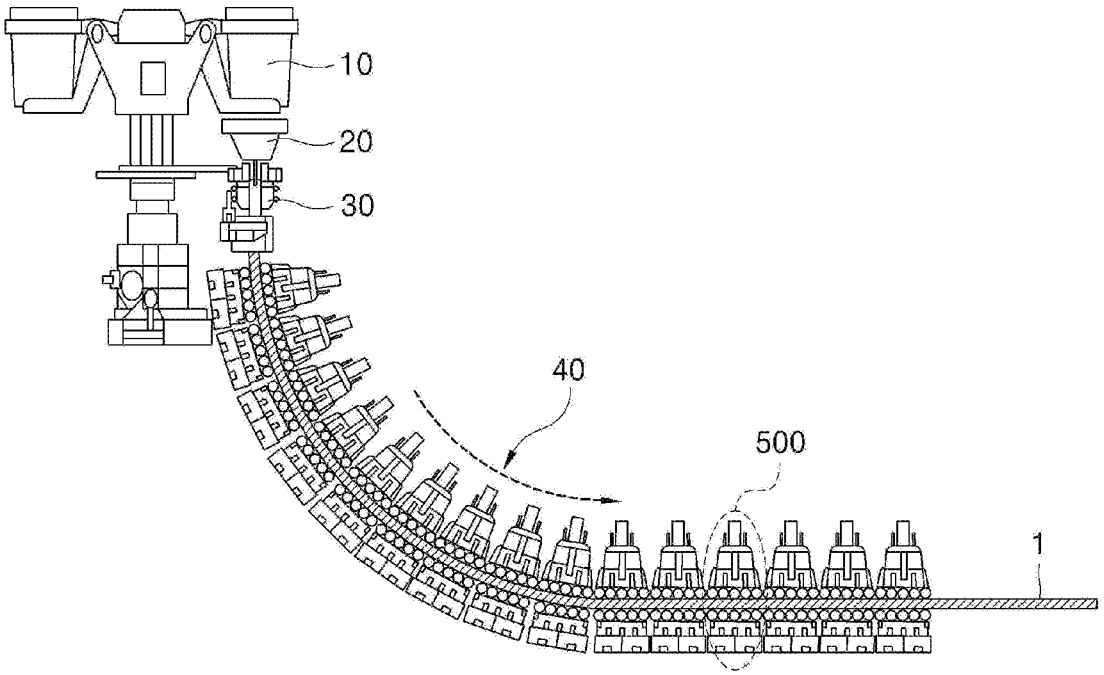
FIG. 1 is a schematic view of a casting apparatus in accordance with an exemplary embodiment.

Hereinafter, embodiments of the present invention will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the inventive concept to those skilled in the art. To describe exemplary embodiments, drawings may be exaggerated and like reference numerals denote like elements in the drawings.

FIG. 1 is a schematic view of a casting apparatus in accordance with an exemplary embodiment.

Referring to FIG. 1, a casting apparatus in accordance with an exemplary embodiment will be described. A casting apparatus in accordance with an exemplary embodiment is a casting apparatus that casts a to-be-treated material such as a slab 1 by using a mold 30 and includes a plurality of segments 500 consecutively arranged under the mold 30 so as to guide the movement of the slab 1 drawn from the mold 30.

The segments 500 may be consecutively arranged in a predetermined direction so as to form a movement path 40 of the slab 1 under the mold 30. That is, the segments 500 may each be installed under the mold 30 and form the movement path 40 of the slab 1. At this point, the shape and the type of the movement path 40 may be diversified. For example, the movement path 40 may be curved or vertically curved, or may be vertical. Meanwhile, the movement path 40 of the slab 1 may be referred to as a cooling line, and the plurality of segments 500 may be referred to as a cooling platform.

Each of the segments 500 may be provided with a plurality of rollers and a coolant nozzle (not shown). Each of the segments 500 may reduce and shape the slab 1 while guiding the slab 1, which is drawn from the mold 30 roll, using the plurality of rollers, and may solidify and cool the slab 1 while spraying a coolant such as cooling water to the slab 1 using the plurality of coolant nozzles.

The casting apparatus in accordance with an exemplary embodiment may further include: a ladle 10 for transporting a molten material, such as a molten steel; a turndish 20 for receiving the molten steel from the ladle 10 and temporarily storing the molten steel; and a mold 30 for receiving the molten steel from the turndish 20 and solidifying the molten steel into a slab form.

The ladle 10, the turndish 20, and the mold 30 described above may have various configurations and types, and are not particularly limited in the exemplary embodiments. In order not to obscure the subject matters of the present disclosure, detailed description thereon will not be provided.

Figure 2:
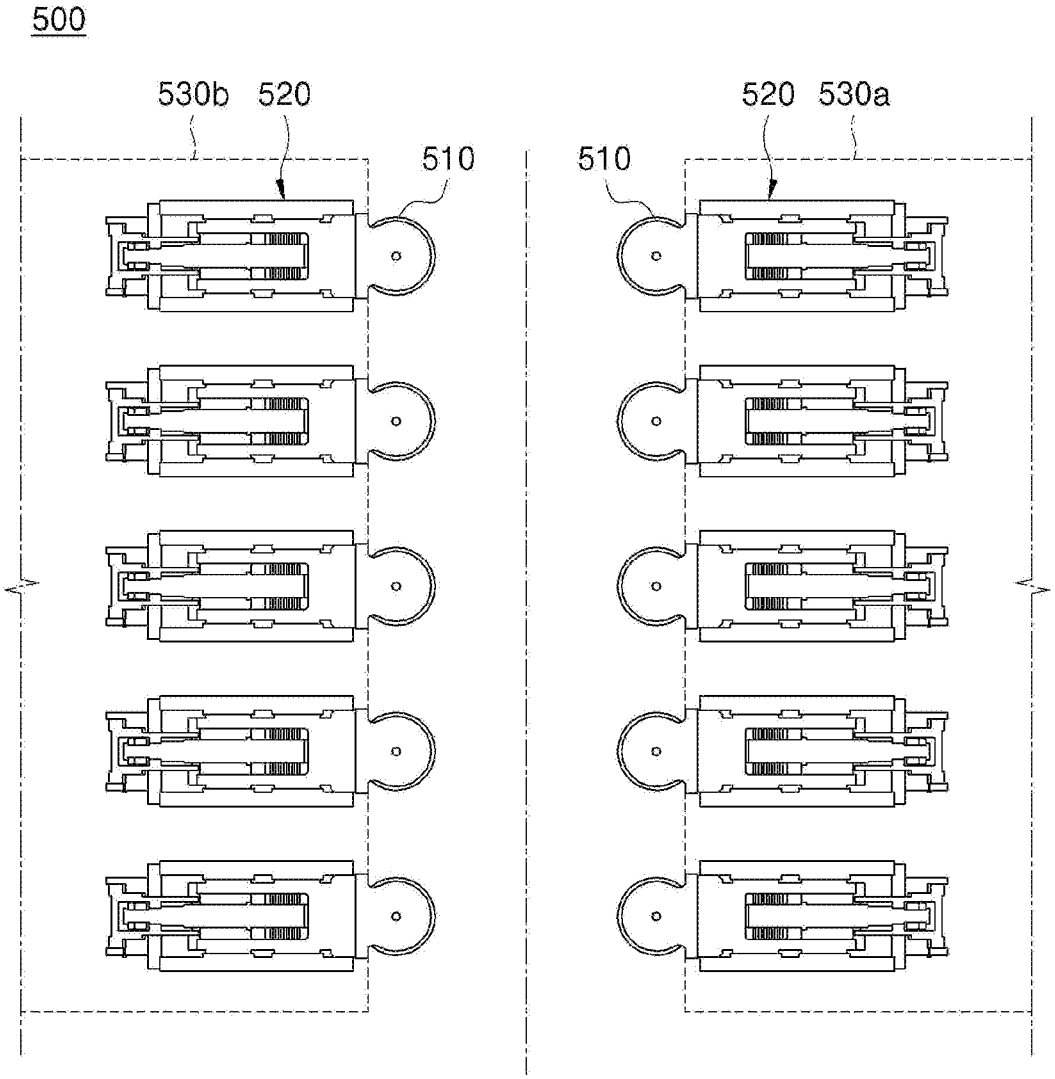
FIG. 2 is a schematic view of a segment according to an exemplary embodiment.

FIG. 2 is a schematic view of segments according to an exemplary embodiment. Referring to FIG. 2, segments in accordance with an exemplary embodiment will be described.

Segments 500 in accordance with an exemplary embodiment include: a plurality of rollers 510 which are consecutively arranged along a movement path 40 so as to be spaced apart from each other and face each other with the movement path 40 of a slab 1 therebetween; and a plurality of roller assemblies 520 which are attached to the plurality of rollers 510 and formed so that at least a portion thereof advances and retreats with respect to the movement path 40.

In addition, the segments 500 may further include a first frame 530*a* and a second frame 530*b* which are spaced apart from each other so as to face each other with the movement path 40 therebetween and support the plurality of roller assemblies 520.

As illustrated in FIG. 2, the plurality of rollers 510 may be consecutively arranged in a direction, in which the movement path extends, at positions spaced apart from each other in a front-rear direction. At this point, the front-rear direction may be the direction in which the first frame 530*a* and the second frame 530*b* are spaced apart from each other when viewed in FIG. 2. Of course, the plurality of rollers 510 may also be consecutively arranged in the direction in which the movement path extends at the position spaced apart from each other in the vertical direction. In this case, the first frame 530*a* and the second frame 530*b* may be arranged so as to be spaced apart from each other in the vertical direction. That is, the plurality of rollers 510, the first frame 530*a* and the second frame 530*b* may be variously arranged in the direction in which the movement path extends.

The plurality of rollers 510 may respectively extend in the left-right direction. Here, the left-right direction may be a direction crossing the above-described front-rear direction and vertical direction, in other words, a direction crossing the movement path.

The first frame 530*a* and the second frame 530*b* are main bodies of the segments 500, and as illustrated in FIG. 2, may be spaced apart from each other in the front-rear direction. Of course, the first frame 530*a* and the second frame 530*b* may also be spaced apart from each other in the vertical direction.

The first frame 530*a* and the second frame 530*b* may be fixedly installed at the respective positions thereof, and may be fixed so that the gap therebetween is a predetermined distance. The plurality of rollers 510 are respectively disposed on the mutually facing surfaces of the first frame 530*a* and the second frame 530*b*, and the slab may be introduced between the first frame 530*a* and the second frame 530*b* and move while supported by the plurality of rollers 510.

The plurality of rollers 510 may be installed so as to be axially rotatable around respective left-right direction shafts (not shown), and to this end, the plurality of roller assemblies 520 may be installed on both left-right direction ends of the respective plurality of rollers 510. The plurality of roller assemblies 520 may support the respective rollers 510 thereof in an axially rotatable manner in the left-right direction.

The plurality of roller assemblies 520 may be spaced apart from each other in the front-rear direction and spaced apart from each other with the plurality of rollers 510 therebetween, and may be attached, in the front-rear direction, to the end sections of the respective rollers 510 so as to connect the rollers 510 on the first frame 530*a* side among the plurality of rollers 510 to the first frame 530*a*, and to connect the rollers 510 on the second frame 530*b* side among the plurality of rollers 510 to the second frame 530*b*.

The segments 500 having the above-described structure may be referred to as fixed roll gap-type segments.

Conversely, as a structure different from that of the above-described exemplary embodiment, for example, segments (not shown) in accordance with a comparative example are configured in a structure in which a first frame and a second frame are installed to be mutually connected by a tie rod, and the gap between the first frame and the second frame is adjusted by a hydraulic cylinder. At this point, the segments in accordance with the comparative example are referred to as segments having a hydraulic cylinder-type roll gap adjustment device, or variable roll gap-type segments.

The segments 500 in accordance with an exemplary embodiment have a merit of easy inspection, maintenance, and repair of equipment than the segments in accordance with the comparative example. In addition, the segments in accordance with the comparative example is not easily operated and handled due to the tie rod weak against damage in high-temperature, high-humidity environment and the hydraulic cylinder, but the segments 500 in accordance with an exemplary embodiment has the first frame 530*a* and the second frame 530*b* fixedly installed to a predetermined positions, and thus may be relatively easy to operate and handle.

Meanwhile, in an emergent situation such as outflow of molten steel or retention of slabs, the rollers 510 may be fused to the slab, but at this point, the rollers 520 may be forcibly retreated from the slab and separated from the slab by using the roller assemblies in accordance with an exemplary embodiment. At this point, a hydraulic pressure is injected into, for example, a later-described plunger 524 of the roller assembly 520, so that the fixed shaft 522 of the roller assembly 520 may be caused to retreat and the roller 510 connected to the fixed shaft 522 may be caused to retreat. Thus, the separation of the roller 510 and the slab may be simply carried out.

That is, the segments 500 in accordance with an exemplary embodiment are fixed roll gap-type segments having a fixed distance between the first frame 530*a* and the second frame 530*b*, have a strong structure, and are easily handled, and even in an emergent situation, the slab and the casting apparatus may be easily separated in order to recover the casting apparatus. Specifically, in an emergent situation, the slab and rollers may be easily separated using the roller assemblies 520.

Figure 3:
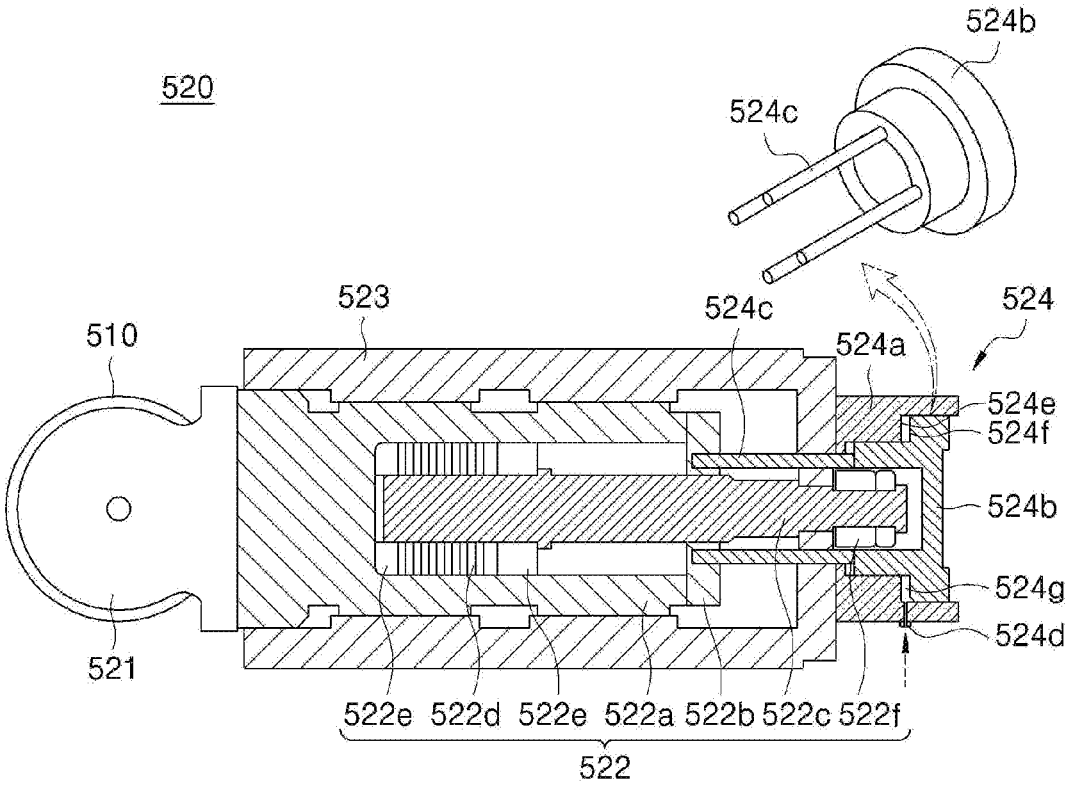
FIG. 3 is a schematic view of a roller assembly according to an exemplary embodiment.
Figure 4:
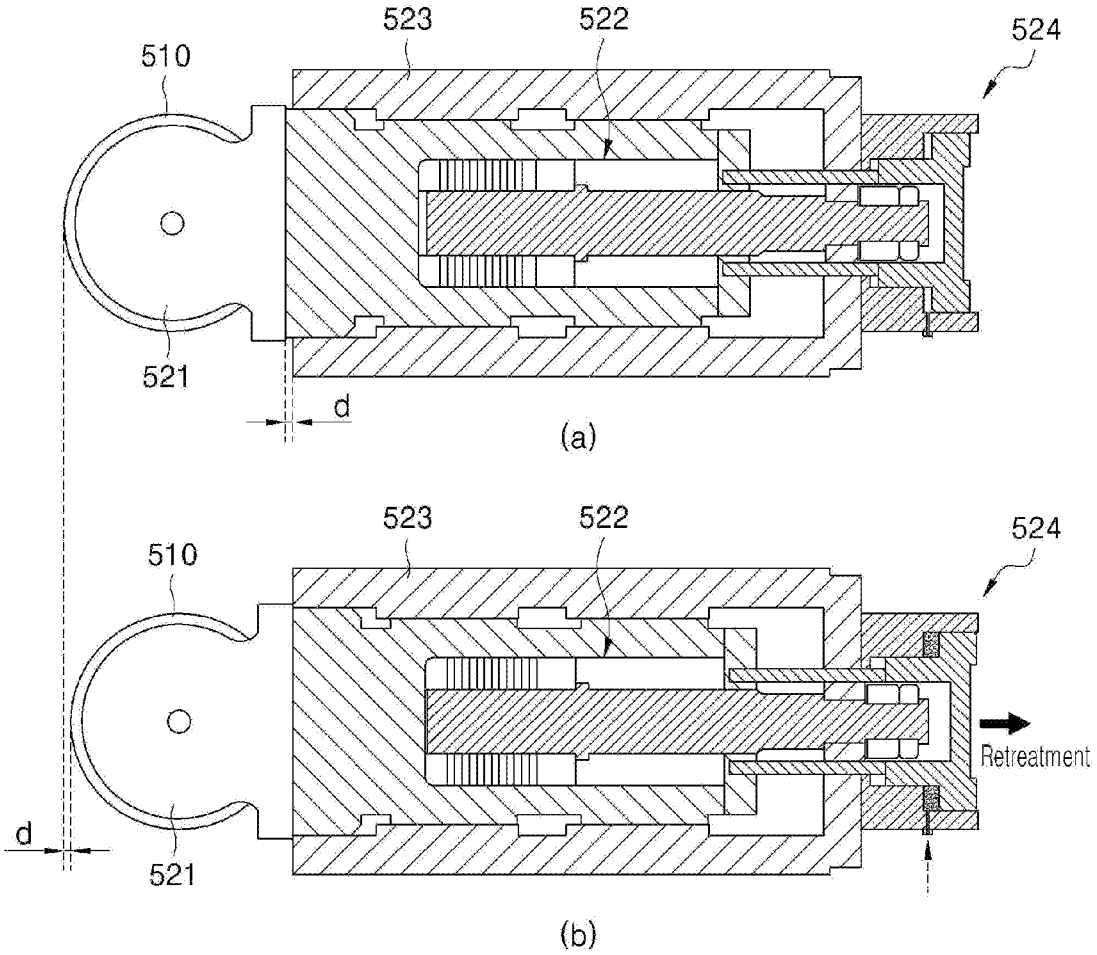
FIG. 4 is an operational view of a roller assembly according to an exemplary embodiment.

FIG. 3 is a schematic view of a roller assembly according to an exemplary embodiment, and FIG. 4 is an operational view of a roller assembly according to an exemplary embodiment. In this case, (a) of FIG. 4 is an operational view of a roller assembly illustrating a state in which a roller in a movement path is supported during a normal operation, and (b) of FIG. 4 is an operational view of the roller assembly illustrating a state in which the roller retreats from the movement path by the roller assembly during emergency.

A roller assembly 520 in accordance with an exemplary embodiment may be used not only as a supporting and retreating device for the roller of the segment 500 in a casting apparatus, but also used as a supporting and retreating device for the roller which is installed in the movement path of equipment for various to-be-treated materials and guides the movement of the to-be-treated material.

Referring to FIGS. 3 and 4, the roller assembly 520 in accordance with an exemplary embodiment will be described in detail. The roller assembly 520 in accordance with an exemplary embodiment is a roller assembly 520 which is capable of causing a roller 510, arranged in the movement path of a to-be-treated material such as a slab, to retreat from the movement path of the slab, the roller assembly including: a supporter 521 that supports the roller 510 in an axially rotatable manner; a fixed shaft 522 attached to the rear surface of the supporter 521 and having at least a stretchable portion; and a body 523 attached to the rear surface side of the supporter 521 so as to surround the fixed shaft 522 and fixed to a predetermined frame which is installed to surround the movement path of the slab; and a plunger 524 attached to pass through the rear surface of the body 523 and connected to the rear end of the fixed shaft 522.

At this point, the plunger 524 may be formed so that at least a portion thereof may advance and retreat by using a hydraulic pressure with respect to the movement path of the slab, and the fixed shaft 522 may cause the roller 510 to retreat from the movement path of the slab while retreating by the plunger 524.

In particular, when casting a thick slab, and when various emergent situations occur, the roller 510 may be forcibly spaced apart from the slab, so that the subsequent repair and recovery may be easy.

Hereinafter, directions used for description of exemplary embodiments are not for limit the exemplary embodiments. The extension direction of the movement path and the arrangement direction of the rollers may be variously different from the installation direction and the extension direction of components of the roller assembly 520.

The supporter 521 may support the roller 510 disposed in the movement path of the slab in an axially rotatable manner. The supporter 521 may be formed in various shapes in which end sections of the roller 510 can be easily attached and supported. For example, the supporter 521 may have: one side which faces frontward, is formed in a disk shape having a smaller diameter than the roller 510, and faces the end sections of the roller 510 in the left-right direction; and the other side which faces rearward, is formed in a bar shape, and faces the front surface of the fixed shaft 522 in the front-rear direction. The one side of the supporter 521 may have a central portion to which the roller 510 is attached in an axially rotatable manner, and the other side may have a rear surface to which the fixed shaft 522 is attached.

The fixed shaft 522 may be attached to the rear surface of the supporter 521 in the front-rear direction. The fixed shaft 522 may be formed such that a plurality of split-type or separate-type shafts are coupled to each other. Meanwhile, when the roller 510 comes into close contact with and rolls the slab, a reaction force due to the ferro-static pressure of the slab may be transferred to the fixed shaft 522 in a form of axial force via the supporter 521. At least a portion of the fixed shaft 522 may be formed to be stretchable in the front-rear direction so as to receive and dissipate the axial force and prevent damage due to the axial force.

The fixed shaft 522 may include: a first shaft 522*a* extending in the front-rear direction and attached to the rear surface of the supporter 521; a first shaft hole penetrating through the rear surface of the first shaft 522*a* and extending in the front-rear direction; a first shaft cover 522*b* attached to the rear surface of the first shaft 522*a*; a second shaft 522*c* which penetrates the first shaft cover 522*b* in the front-rear direction, and has one side disposed inside the first shaft hole and spaced apart from the inner surface of the first shaft hole, and the other side attached to penetrate through the center of the rear surface of the body 523 in the front-rear direction; a ring-like protrusion protruding on the one-side outer circumferential surface of the second shaft 522*c*; elastic members, such as, a plurality of cup springs 522*d*, supported on the one-side outer circumferential surface of the second shaft 522*c* in front of the ring-like protrusion and contacting each other in the front-rear direction; a pair of scissors washers 522*e* which are disposed on the front and rear sides of the plurality of cup springs 522*d* and supported by the one-side circumferential surface of the second shaft 522*c*, and which are in close contact with each of the mutually facing surfaces of the first shaft hole and the ring-like protrusion by the ring-like protrusion, and in close contact with the plurality of cup springs 522*d*; and a snap ring 522*f* attached to the other-side outer circumferential surface of the second shaft 522*c* so as to fix the other side of the second shaft 522*c* to the rear surface of body 523.

The second shaft 522*c* is attached to the rear surface of the body 523 and the movement thereof in the front-rear direction is constrained, and the first shaft 522*a* may advance and retreat while supported by the outer circumferential surface of the second shaft 522*c*. At this point, the first shaft hole and the plurality of cup springs 522*d* may guide and accommodate the advancing and retreating movement of the first shaft 522*a*. Accordingly, the fixed shaft 522 is stretchable in the front-rear direction, and prevent the damage due to the axial force while receiving and dissipating the axial force.

The body 523 may extend in the front-rear direction, the inside thereof may be open frontward, and the body may be attached to the rear surface side of the supporter 521 so as to surround the fixed shaft 522. The body 523 may have a rectangular column shape, but exemplary embodiments are not particularly limited thereto. The body 523 is disposed so as to be spaced apart from the rear side of the supporter 521 rearward, and the fixed shaft 522 may be installed inside the body 523. The second shaft 522*c* of the fixed shaft 522 may be attached to and supported by the rear surface of the body 523. The fixed shaft 522 may be accommodated inside the body 523 and the fixed shaft 522 may be supported by the inner surface of the body 523. The fixed shaft 522 may be disposed so as to penetrate the inside of the body 523 in the front-rear direction. The outer surface of the body 523 may be attached to and supported by the first frame 530*a* or the second frame 530*b*. The front end of the body 523 may be spaced apart a predetermined distance d from the rear surface of the supporter 521.

The plunger 524 may be attached passing through the rear surface of the body 523 and connected to the rear end of the fixed shaft 522. The plunger 524 may be attached by connecting the body 523 and the fixed shaft 522. At least a portion of the plunger 524 may be formed so as to advance and retreat with respect to the movement path of the slab, and at least a portion of the plunger may be formed so as to retreat by using hydraulic pressure and cause the fixed shaft 522 to retreat from the movement path of the slab. The hydraulic pressure may be applied to the fixed shaft 522 in a direction away from the slab via the plunger 524, and accordingly, the fixed shaft 522 retreats a predetermined distance and pulls the supporter 521 rearward, so that the roller 510 may be spaced apart from and separated from the slab while retreating from the movement path of the slab. That is, the plunger 524 functions to separate the roller 510 from the slab.

The plunger 524 may include: a hollow outer cylinder 524*a* having a front end attached to the rear surface of the body 523, and an inner stepped portion 524*e* formed in the inner circumferential surface thereof, the inner diameter of a rear side from the inner stepped portion 524*e* being larger than the inner diameter of a front side thereof; an inner cylinder 524*b* attached to pass through the center of the outer cylinder 524*a* and having an outer stepped portion 524*f* on the outer circumferential surface thereof, the outer circumferential surface thereof being in contact with the inner circumferential surface of the outer cylinder 524*a*; a plurality of connecting shafts 524*c* formed to protrude from the front end of the inner cylinder 524*b*, passing through the rear surface of the body 523, and connected to the rear end of the fixed shaft 522, for example, to the first shaft cover 522*b*; an injection port 524*d* attached to pass through the outer cylinder 524*a* so as to form a hydraulic pressure by injecting a fluid into a hydraulic pressure space 524*g* formed by the inner stepped portion 524*e* and the outer stepped portion 524*f*, and an injection port valve (not shown) attached to the injection port 524*d* and opened in an intermittent manner.

The outer cylinder 524*a* may extend in the front-rear direction and be formed in a hollow cylinder shape. The inner cylinder 524*b* may pass through the center of the outer cylinder 524*a* and be attached in movable manner in the front-rear direction. The inner cylinder 524*b* may have an inner portion open frontward, be disposed inside the outer cylinder 524*a*, and may accommodate therein the other side of the second shaft 522*c*. Mutually facing outer circumferential surface and inner circumferential surface of the outer cylinder 524*a* and inner cylinder 524*b* may be in contact or close contact with each other, and a hydraulic pressure space 524*g* may be formed. Meanwhile, an inclined surface may be formed on the one-side outer stepped portion 524*f* of the inner cylinder 524*b* contacting the injection port 524*d* so that the fluid may easily be injected to apply hydraulic pressure.

The connection shafts 524*c* may be formed in bolt shapes, the front end thereof may be attached to the rear end of the fixed shaft 522, and the rear end thereof may be connected to the front end of the inner cylinder 524*b* and move linked to the movement of the inner cylinder 524*b*. Accordingly, the fixed shaft 522 and the inner cylinder 524*b* may move together in the same direction via the connection shafts 524*c*.

The injection port valve (not shown) may apply the hydraulic pressure step by step by opening the injection port 524*d* in an intermittent manner when the fluid for the hydraulic pressure is injected. That is, the hydraulic pressure may be applied step by step even when the hydraulic space 524*g* is a single connected space, and accordingly, a suitable amount of the fluid may be divided and supplied to the hydraulic space 524*g* according to the fused state of the roller 510 and the slab.

Hereinafter, the retreating process of the roller 510 using the plunger 524 will be described.

For example, when the hydraulic pressure-forming fluid is injected into the injection port 524*d* using a grease gun, the inner cylinder 524*b* retreats while the hydraulic space 524*g* is expanded, and accordingly, the connection shaft 524*c* retreats and causes the fixed shaft 522 to retreat. In this case, the movement of the fixed shaft 522 may be received by the first shaft hole and the plurality of cup springs 522*d*. When the fixed shaft 522 retreats by the gap d between the supporter 521 and the body 523, the roller 510 may also retreat by the gap d. At this point, the hydraulic pressure applied to the injection space 524*g* for the retreatment of the roller 510 may be sufficiently applied by a portable hydraulic pressure application device such as a grease gun. The roller 510 is forcibly spaced apart from a slab due to the retreatment of the roller 510, and the roller fused to the slab may be separated from the slab. Accordingly, in a situation in which the slag and the roller 510 are fused during molten steel outflow, the roller 510 and the slab may easily be separated from each other without damage to the apparatus, and thereafter the recovery operation of the casting apparatus may easily be carried out.

A roller separating method for a casting apparatus in accordance with an exemplary embodiment will be described with reference to FIGS. 1 to 4. A roller separating method in accordance with an exemplary embodiment is a method for separating a roller from a slab in a movement path, the method including: drawing a slab from a mold; guiding the movement of the slab drawn from the mold using a plurality of segments consecutively arranged along the movement path; and causing a plurality of roller assemblies, which are attached to a plurality of rollers provided to the segments, and have at least a portion formed so as to advance and retreat with respect to the movement path of the slab, to retreat from the movement path of the slab and causing the rollers supported by the roller assemblies to be spaced apart from the slab when the slab is being moved or stops.

First, a casting apparatus in accordance with the above-described exemplary embodiment is prepared, and a melt, such as a molten steel, is injected into the mold 30 and solidified into a slab, and the slab is continuously drawn downward.

Subsequently, while passing the slab 1 between a first frame 530*a* and a second frame 530*b* of the segments 500, the movement of the slab is guided by using the rollers 510. Subsequently, when various emergent situations occur such as outflow of the molten steel, or retention of slabs, casting is stopped. At this point, the slab may be in a stopped state or in a moving state.

Next, a hydraulic pressure is formed by injecting a fluid into a plunger 524 of the roller assembly 520, and causes a portion of the roller assembly 520, for example, a fixed shaft 522 to retreat. As the fixed shaft 522 is caused to retreat, the roller 510 supported by a supporter 521 may be spaced apart from the movement path of the slab At this point, the hydraulic pressure may be applied into the plunger 524 in a intermittent manner, and an operation may be efficiently carried out by applying a required amount of hydraulic pressure.

The above-mentioned exemplary embodiments are provided not to limit but to describe the present disclosure. The configuration and method disclosed in the above exemplary embodiments may be combined or shared with each other to be modified into various forms, and it should be noted that the modified embodiments belong to the scope of the present disclosure. That is, the present invention would be implemented in various forms different from each other within the scope of claims and technical spirit equivalent thereto, and it will be readily understood by those skilled in the art that various modifications and changes can be made thereto without departing from the spirit and scope of the present invention defined by the appended claims.

What is claimed is:

1. A casting apparatus for casting a slab using a mold, the casting apparatus comprising:

a plurality of segments consecutively arranged under a mold so as to guide a movement of a slab drawn from the mold, wherein the segments each comprises:

a plurality of rollers consecutively arranged along a movement path of the slab and spaced apart from each other so as to face each other with the movement path therebetween; and a roller assembly attached to each of the rollers, and wherein the roller assembly comprises:

a body;

a first shaft movably installed inside the body;

a supporter fixed to one end portion of the first shaft and configured to rotatably support the each of the rollers;

a plunger coupled to the other end portion of the first shaft and configured to be hydraulically operated to retreat the first shaft from the movement path of the slab and advance the first shaft towards the movement path of the slab;

a second shaft movably inserted into an insertion hole formed at the other end portion of the first shaft, one end portion of the second shaft being fixed to the body; and an elastic member installed inside the insertion hole, wherein the elastic member elastically couples the first shaft and the second shaft to each other and guides retreating and advancing movement of the first shaft.

2. The casting apparatus of claim 1, wherein the segments each comprises: a frame supporting the roller assembly; and wherein the frame comprises: a first frame and a second frame spaced apart from each other so as to face each other with the movement path of the slab therebetween.

* * * * *